US010092050B2

(12) United States Patent
Skurla, III

(10) Patent No.: US 10,092,050 B2
(45) Date of Patent: Oct. 9, 2018

(54) GOLF JACKET HAVING WEATHER-PROTECTIVE COLLAR

(71) Applicant: Acushnet Company, Fairhaven, MA (US)

(72) Inventor: Peter J. Skurla, III, Bridgewater, MA (US)

(73) Assignee: Acushnet Company, Fairhaven, MA (US)

( * ) Notice: Subject to any disclaimer, the term of this patent is extended or adjusted under 35 U.S.C. 154(b) by 107 days.

(21) Appl. No.: 14/547,186

(22) Filed: Nov. 19, 2014

(65) Prior Publication Data

US 2016/0135527 A1 May 19, 2016

(51) Int. Cl.

| | |
|---|---|
| ***A41D 27/18*** | (2006.01) |
| ***A41D 3/00*** | (2006.01) |
| ***A41D 1/04*** | (2006.01) |

(52) U.S. Cl.

CPC ..... *A41D 27/18* (2013.01); *A41D 1/04* (2013.01); *A41D 3/00* (2013.01); *A41D 2600/10* (2013.01)

(58) Field of Classification Search

CPC ... A41D 1/00; A41D 1/02; A41D 3/00; A41D 3/02; A41D 13/00; A41D 27/18; A41D 1/04

USPC ..... 2/93, 98, 100, 129, 60, 108, 90

See application file for complete search history.

(56) References Cited

U.S. PATENT DOCUMENTS

| | | | | | |
|---|---|---|---|---|---|
| 1,158,290 | A * | 10/1915 | Rheinauer | A41D 1/04 | 2/90 |
| 2,234,035 | A * | 3/1941 | Wolf | A41B 3/14 | 2/116 |
| 2,269,491 | A * | 1/1942 | Snyder | A41D 1/04 | 2/116 |
| 2,310,899 | A * | 2/1943 | Leeds | A41B 3/00 | 2/116 |
| 3,147,490 | A * | 9/1964 | Allen | A41D 3/00 | 2/84 |
| 3,725,954 | A * | 4/1973 | Baldini | A41B 3/10 | 2/143 |
| 4,620,324 | A * | 11/1986 | Parr | 2/91 | |
| 294,305 | A | 2/1988 | Meek | | |
| 4,864,656 | A * | 9/1989 | Nesse | 2/97 | |
| 5,406,648 | A * | 4/1995 | Butzer | A62B 17/003 | 2/100 |
| 5,946,724 | A | 9/1999 | Erickson | | |
| 6,052,826 | A | 4/2000 | Tolton | | |
| 6,934,970 | B1 * | 8/2005 | Watkins et al. | 2/96 | |
| 7,003,812 | B1 * | 2/2006 | Lewis et al. | 2/468 | |
| 7,117,538 | B2 | 10/2006 | Bosne et al. | | |
| D639,025 | S | 6/2011 | Holder | | |

(Continued)

*Primary Examiner* — Sally Haden
*Assistant Examiner* — Jillian K Pierorazio
(74) *Attorney, Agent, or Firm* — Daniel W. Sullivan

(57) ABSTRACT

Golf jackets having improved collar constructions are provided. The golf jacket includes a shaped collar having lower and upper edges. The height of the center section of the collar is longer than the height of the first and second end sections of the collar. When closed, the collar can provide an effective weather-proof seal around the neck region. The jacket is durable and the collar construction protects the wearer from rain, wind, and other inclement weather conditions. The jacket and collar also are comfortable and sufficiently flexible. The jacket provides the golfer with a complete range of motion so that he/she can play the game more easily.

5 Claims, 7 Drawing Sheets

(56) References Cited

U.S. PATENT DOCUMENTS

| | | | | |
|---|---|---|---|---|
| 7,954,173 | B2 * | 6/2011 | Collier | A41D 1/06 2/108 |
| 8,341,766 | B2 | 1/2013 | Rodriquez et al. | |
| D698,524 | S * | 2/2014 | Roberts | D2/839 |
| D698,525 | S | 2/2014 | Roberts et al. | |
| D698,527 | S | 2/2014 | Roberts et al. | |
| 2004/0143880 | A1 * | 7/2004 | Clark | A41D 3/00 2/69 |
| 2005/0229283 | A1 * | 10/2005 | Towle et al. | 2/93 |
| 2006/0236440 | A1 * | 10/2006 | Zahler | A41D 1/02 2/69 |
| 2006/0253958 | A1 * | 11/2006 | Debrick | A41D 23/00 2/206 |
| 2008/0163404 | A1 | 7/2008 | Carpentier et al. | |
| 2009/0249529 | A1 | 10/2009 | Rodriquez et al. | |
| 2010/0031415 | A1 * | 2/2010 | Shadid | 2/87 |
| 2010/0320241 | A1 * | 12/2010 | Thompson | 224/153 |
| 2011/0099685 | A1 | 5/2011 | Siragusa | |

* cited by examiner

GOLF JACKET HAVING WEATHER-PROTECTIVE COLLAR

BACKGROUND OF THE INVENTION

Field of the Invention

The present invention relates generally to golf jackets and more particularly to golf jackets having weather-protective shaped collars. The jacket is suitable for wearing on and off the golf course.

Brief Review of the Related Art

Both professional and amateur golfers use specialty golf outerwear, particularly golf jackets today. Typically, the jacket includes a shell made of multiple layers of bonded fabric. The fabric is breathable and wicks moisture and perspiration away from the person wearing the jacket. Many of the jackets provide a high range of motion so golfers enjoy wearing the jacket while walking and playing the course, particularly when there is inclement weather. The jackets provide protection against windy and rainy conditions and many jackets are made of waterproof material. Some of the jackets also are considered fashionable and golfers enjoy wearing these jackets off the course.

For example, Rodriguez et al., U.S. Pat. No. 8,341,766 discloses a golf jacket having a jacket shell with a pocket in an upper region. A semi-rigid collar is stored in the pocket. When the golfer wants to use the collar, they partially remove it from the pocket. Thus, the semi-rigid collar can be moved between a storage position inside of the pocket to a use position outside of the pocket.

Erickson, U.S. Pat. No. 5,946,724 discloses a golf jacket having a liner, shell, and elastic cinch. The opposing ends of the cinch are anchorable to the jacket shell and protrude to the outside. The cinch protrudes through holes in the shell that are disposed within pockets on the outside of the shell. When the ends of the cinch are anchored to the shell, the cinch flattens the front of the abdomen, preventing otherwise bunched-up fabric from interfering with the wearer's golf swing. The tension in the cinch is adjustable by anchoring the cinch end to the shell in one of various relative positions.

Meek, U.S. Design Pat. No. D294,395 discloses a design for a golf jacket.

Although some conventional golf jackets are somewhat effective in providing protection against various weather conditions, there is a need for an improved jacket. Particularly, there is a need for a golf jacket having a collar construction that creates a more effective water-tight seal without sacrificing comfort. The collar should have sufficient rigidity and yet be comfortable around the neck region. Also, the collar should be constructed so that it does not distract or interfere with a golfer while they are bending over to address the ball and make a shot. The present invention provides new golf jackets with collar structures having improved weather-protective features and comfort as well as other advantageous properties, features, and benefits.

SUMMARY OF THE INVENTION

The present invention generally relates to a golf jacket having an improved collar structure. The jacket comprises a shell having: i) a torso portion that extends from a shoulder region to hip region of a wearer; ii) a collar portion that extends around a neck region of a wearer. The torso and collar portions each include first and second side members that are joined by a zipper extending along the length of the jacket shell. The zipper includes first and second sets of complementary zipper teeth for fastening the first and second side members of the respective torso and collar portions.

The collar includes a body member having upper and lower edges. The body member also has a center section and first and second pieced end sections. In the collar portion, the first zipper teeth are attached to an edge of the first pieced section, and the second zipper teeth are attached to an edge of the second pieced section. The center section of the collar has a height from the lower edge to the upper edge (H1), and each end section has a height from the lower edge to the upper edge (H2). The H1 and H2 have different values. In particular, the height of the center section is greater than the height of the end sections. For example, in one version, the height of the center section (H1) is about 3.25 inches; while the height of each end section (H1 and H2) is about 2.6 inches. In one preferred embodiment, the H1 and H2 have the mathematical relationship of: $H1 \geq (1.2)H2$. In another preferred embodiment, the H1 and H2 have the mathematical relationship of: $(1.2)H2 < H1 < (1.4)H2$.

The jacket and particularly the collar assembly of this invention have both sufficient rigidity and flexibility. The collar is durable and provides good weather-protection against the elements and yet it is also comfortable. A person wearing the jacket is free to move in any direction. The jacket is described primarily herein as being used in golf, but the jacket can be worn while performing many other activities including, for example, tennis, boating, exercise classes, running, and walking.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Figure 1:
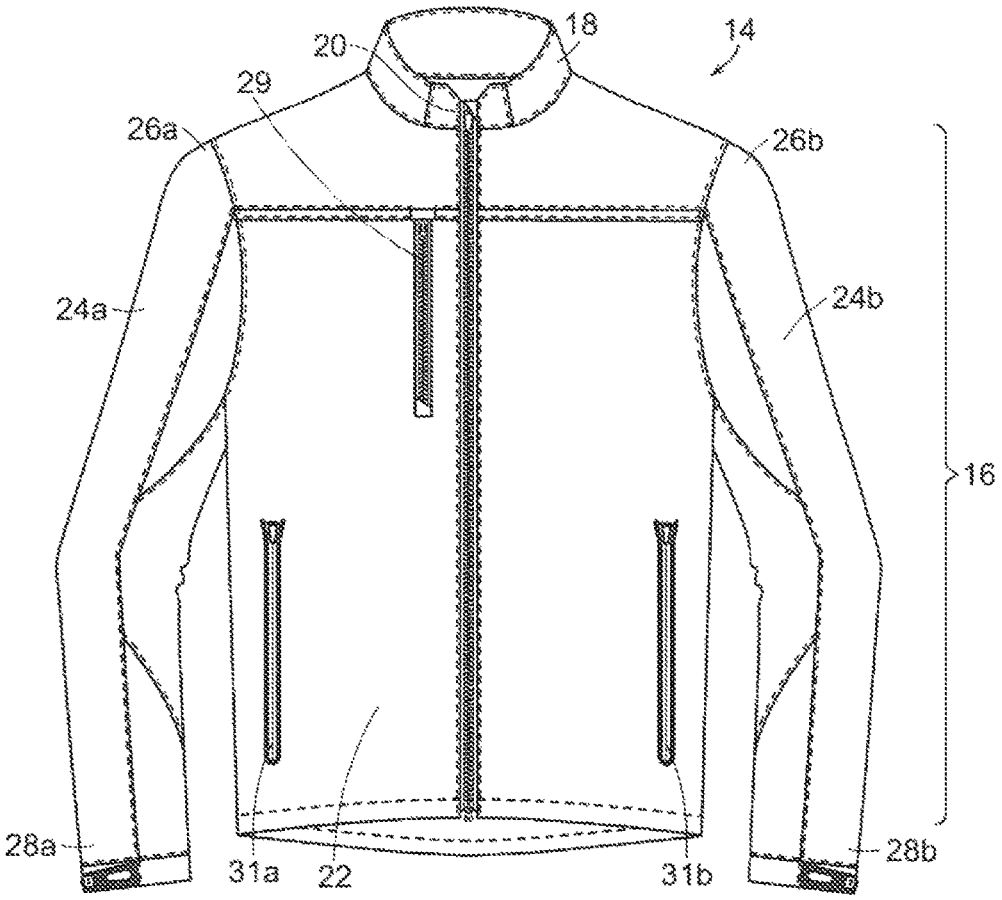
FIG. 1 is a front perspective view of a golf jacket of the present invention.
Figure 1A:
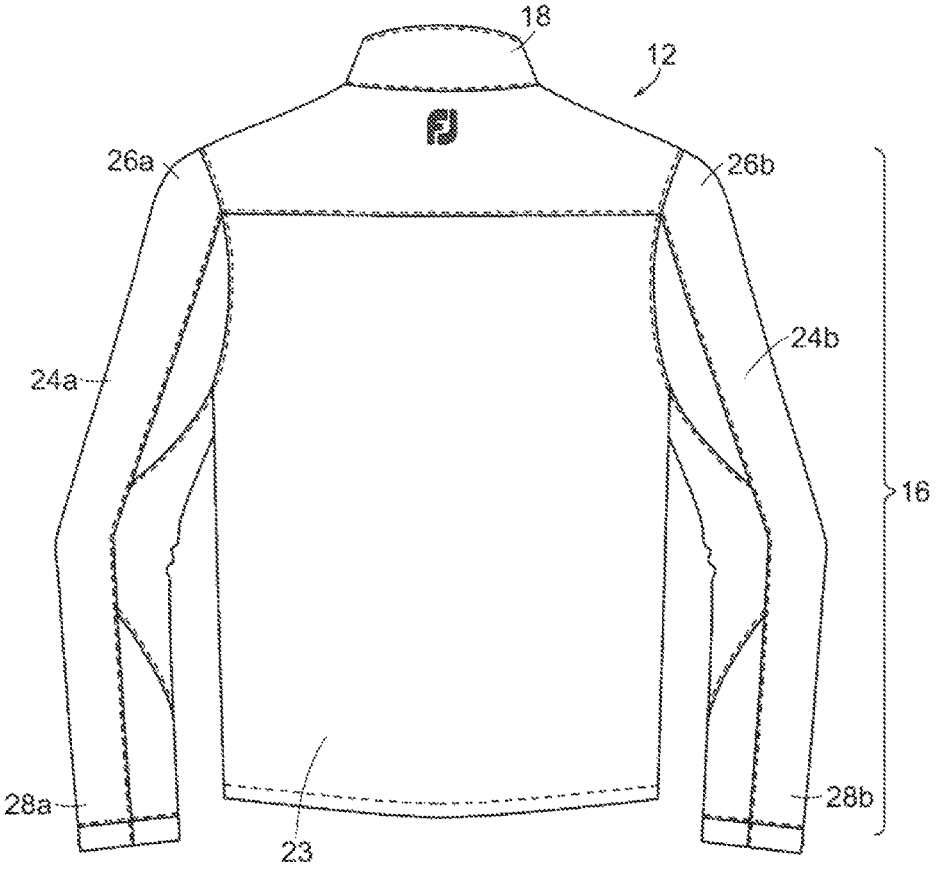
FIG. 1A is a rear perspective view of the golf jacket shown in FIG. 1.

Referring to FIGS. 1 and 1A, the jacket of the present invention is indicated at (14) and generally includes a jacket shell having a torso portion (16), an integrated collar portion (18), and a zipper (20) that extends from the torso to collar portions. The jacket includes an outer surface and an inner surface, allowing a person to wear the jacket over their body in a normal manner. In a preferred embodiment, the jacket shell (14) is made of a three-layer bonded waterproof fabric. The inside layer is a brushed knit tricot. The middle layer is a polyurethane membrane. The outer layer is a polyester woven fabric with mechanical stretch and durable water repellent (DWR) finish.

The torso portion (16) includes a front section (22) as shown in FIG. 1 and a rear section (23) as shown in FIG. 1A. In general, the torso portion (16) extends from the shoulder region to the hip region of a wearer. The jacket shell (14) further includes sleeves (24*a*, 24*b*) that extend from the arm openings inside of the shell. The right sleeve (24*a*) extends from a right shoulder region (26*a*) to a right wrist region (28*a*), and the left sleeve (24*b*) extends from a left shoulder region (26*b*) to a left wrist region (28*b*) of a wearer.

The front section (22) of the jacket shell (14) is split into two side members by a zipper (20) or other suitable fastening means (for example, buttons, snap fasteners, laces, Velcro® hook and loop fasteners, and the like). A traditional zipper (20) may be used in the jacket shell construction. The zipper includes first and second sets of complementary zipper teeth for fastening the first and second side members of the front section together. The first and second side members of front section are joined and held together by the zipper. The zipper also joins the first and second side members of the collar region as discussed further below. In this manner, the jacket shell can be closed to cover the collar, torso, shoulder, and arm regions of the person wearing the jacket. Additionally, the jacket shell may include a pocket in the upper regions of the torso portion. For example, the jacket shell (14) may include a zippered pocket (29) in the upper chest area as shown in FIG. 1. The jacket also may include pockets in the lower side regions of the torso portion for placing hands or various objects. These pockets may be opened and closed by a zipper or other suitable releasable closing means. For example, the jacket shell (14) may include right-sided and left-sided zippered pockets (31*a*, 31*b*) as shown in FIG. 1.

Figure 2:
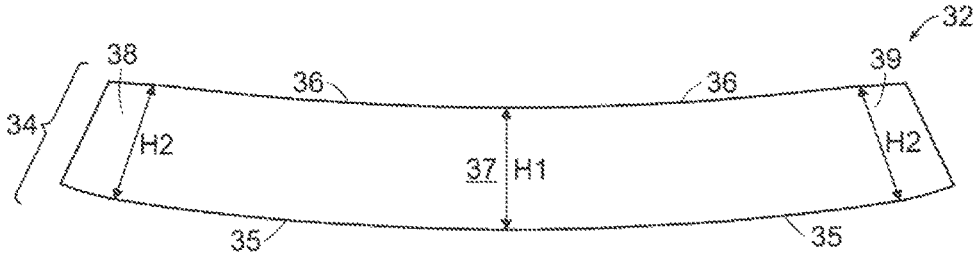
(Prior Art) FIG. 2
FIG. 2 is a schematic view of a collar of a golf jacket of the prior art.
Figure 3:
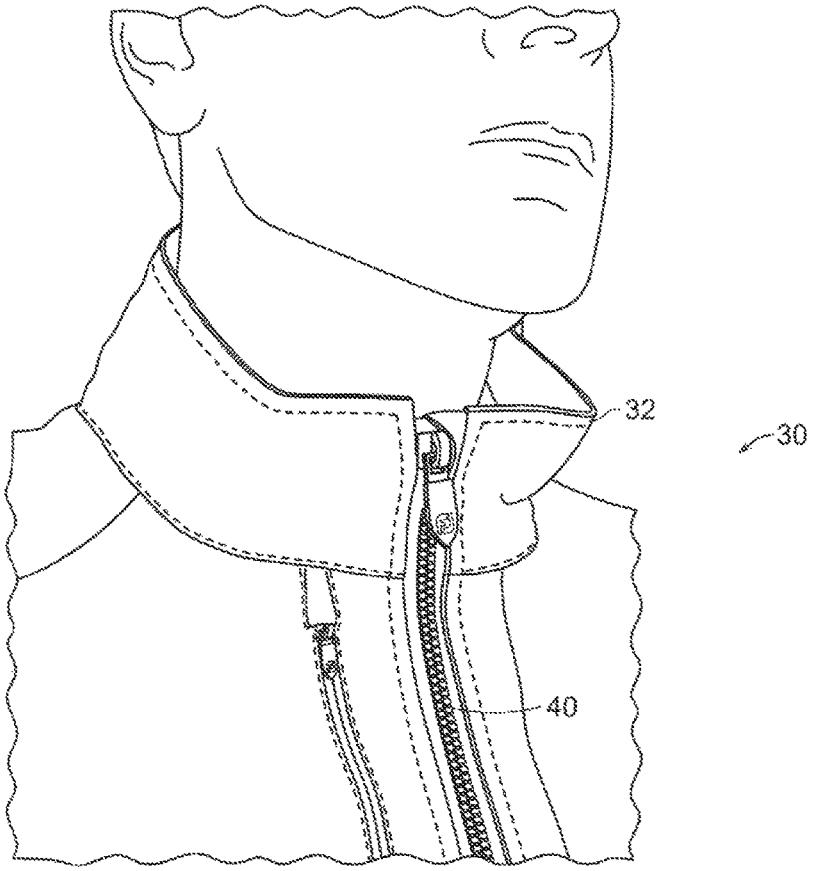
(Prior Art) FIG. 3
FIG. 3 is a front perspective view of a collar of a golf jacket of the prior art.

Turning to FIGS. 2 and 3, a golf jacket and particularly a collar construction of the prior art are shown. The prior art golf jacket (30) includes a collar (32) having a body member (34) with lower and upper edges (35, 36), the body member having a center section (37) and first and second end sections (38, 39). The end sections are not pieced sections; they are not joined to the body member by a seam of stitching. The center section (37) has a height from the lower edge (35) to the upper edge (36) indicated as (H1), and the end sections (38, 39) have a height from the lower edge (35) to the upper edge (36) indicated as (H2). In the golf jackets of the prior art, H1 and H2 are substantially the same dimensions. The conventional golf jacket (30) further includes a zipper (40) for closing the jacket including collar.

Figure 4:
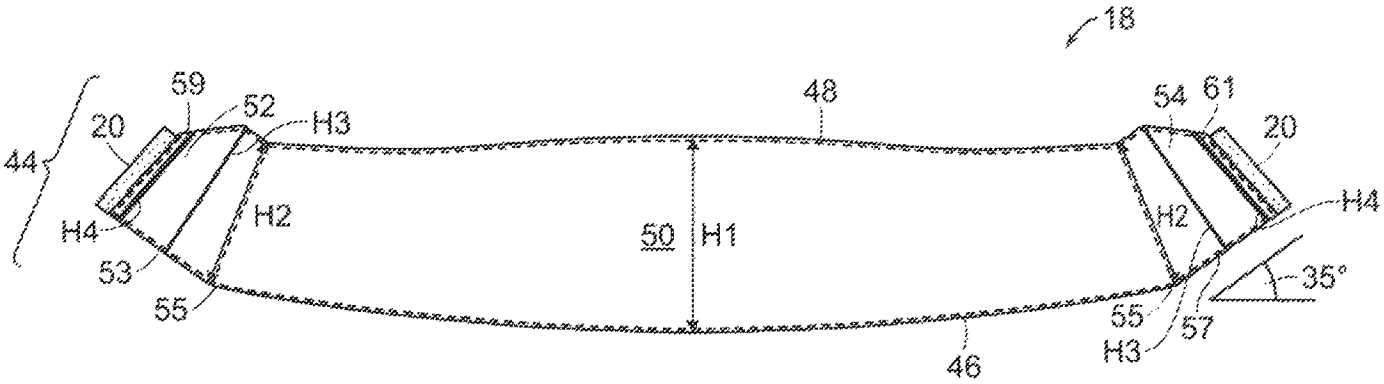
FIG. 4 is a schematic view of one embodiment of a golf jacket collar of the present invention showing an outside view of the collar.
Figure 4A:
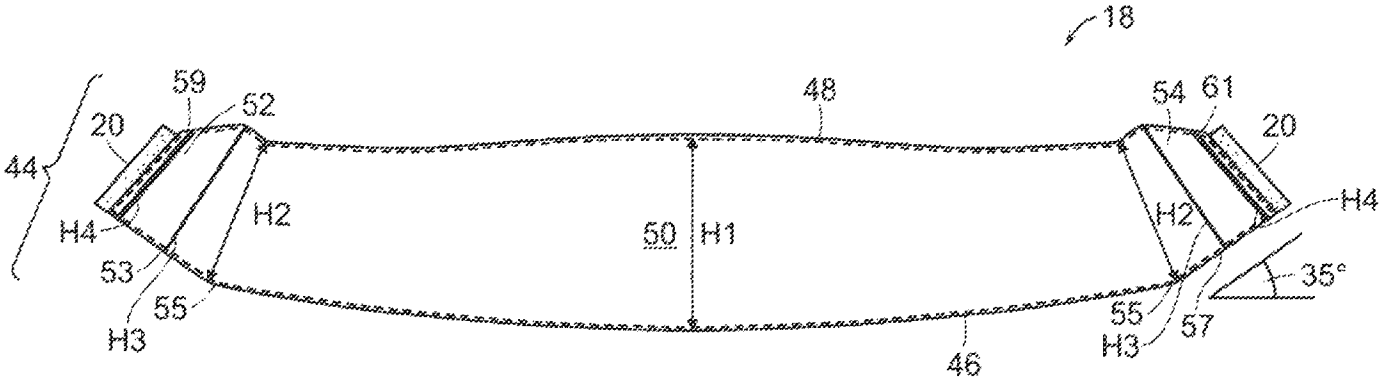
FIG. 4A is another schematic view of the collar of FIG. 4 showing an inside view of the collar.

Referring back to FIG, 1, the golf jacket (12) of the present invention having an improved collar structure (18) is shown. The shaped collar (18) is shown in more detail in FIGS. 4, 4A, and 5. Referring to FIGS. 4 (outside view of the collar with piecing of sections shown) and 4A (inside view of the collar with piecing of sections not shown), the collar (18) includes a body, member (44) with a lower edge (46) and upper edge (48). The body member has a center section (50) and a first end section (52) and second end section (54). The collar end sections (52, 54) are pieced sections and are joined to the body member (44) by a seam of stitching (55). As shown in FIGS. 4 and 4A, the collar end sections (52, 54) extend outwardly at an angle, where the sections are seamed to the collar body (44). The respective collar end sections (52, 54) have lower edges (53, 57) that extend upwardly and form an angle with the lower edge (46) of the collar body member, and the angle of each of these collar edges is preferably thirty-five degrees (35°). The center section (50) has a height from the lower edge (46) to the upper edge (48) indicated at (H1). Meanwhile, the end section (52) has a height from its lower edge (53) to its upper edge (59) indicated at (H2). Likewise, the end section (54) has a height from it lower edge (57) to its upper edge (61) also indicated at (H2). The height of each collar end section (52, 54) is the same; however, the height of the collar center section (50) is different than the height of the end sections (52, 54). Thus, (H1) and (H2) are unequal numerical values, and preferably are substantially unequal. The shaped collar (42) has different height dimensions along its length. As shown in FIGS. 4 and 4A, each of the end sections (52, 54) has a height from their lower edge to their apex (H3), and the end sections (52, 54) also have a height from their lower edge to their upper edge of the zipper (20) designated as (H4), wherein the H1; H2; H3; and H4 numerical values are unequal. Preferably, H3 is greater than H1 which is greater than H2 which is greater than H4. The center and end sections of the shaped collar (42) are non-uniform in height. In particular, the height of the center section (50) is greater than the height of the first and second end sections (52, 54), and this is an advantageous feature as discussed further below. For example in one embodiment, the height of the center section (H1) is 3.25 inches; while the height of each end section (H2) is 2.6 inches.

Figure 1B:
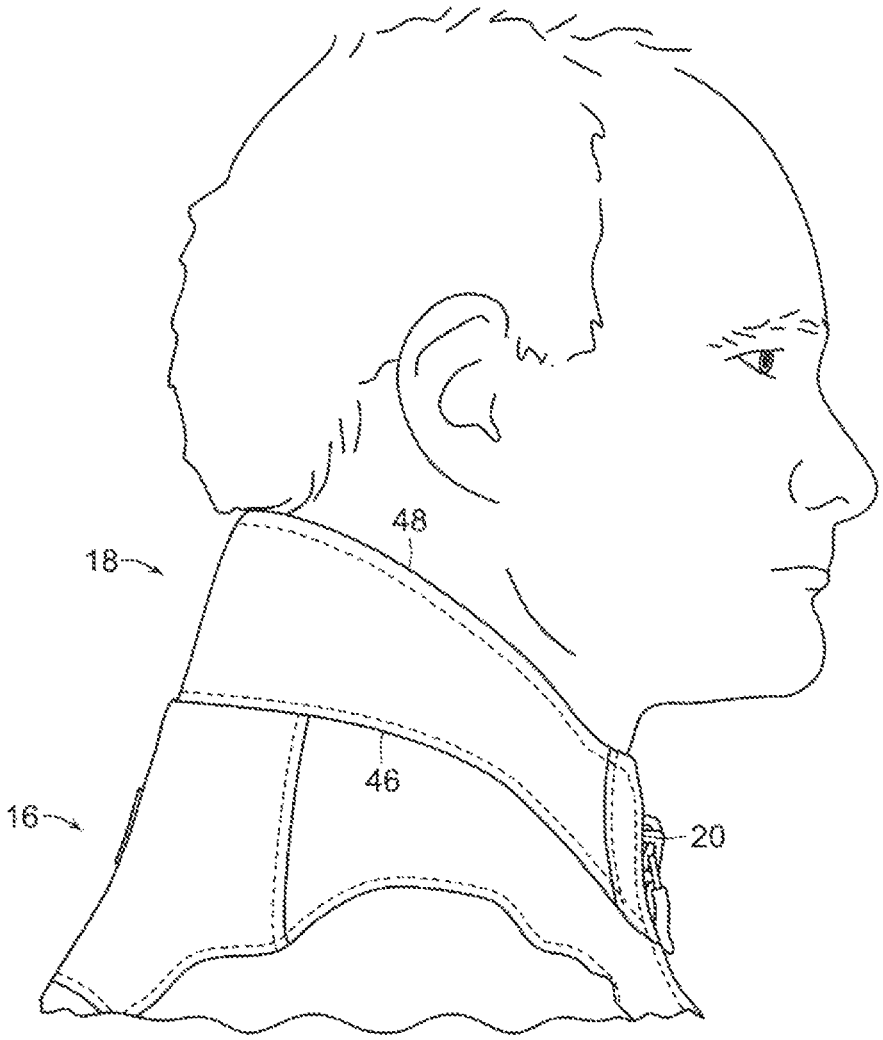
FIG. 1B is a close-up side view of the golf jacket collar shown in FIG. 1.
Figure 1C:
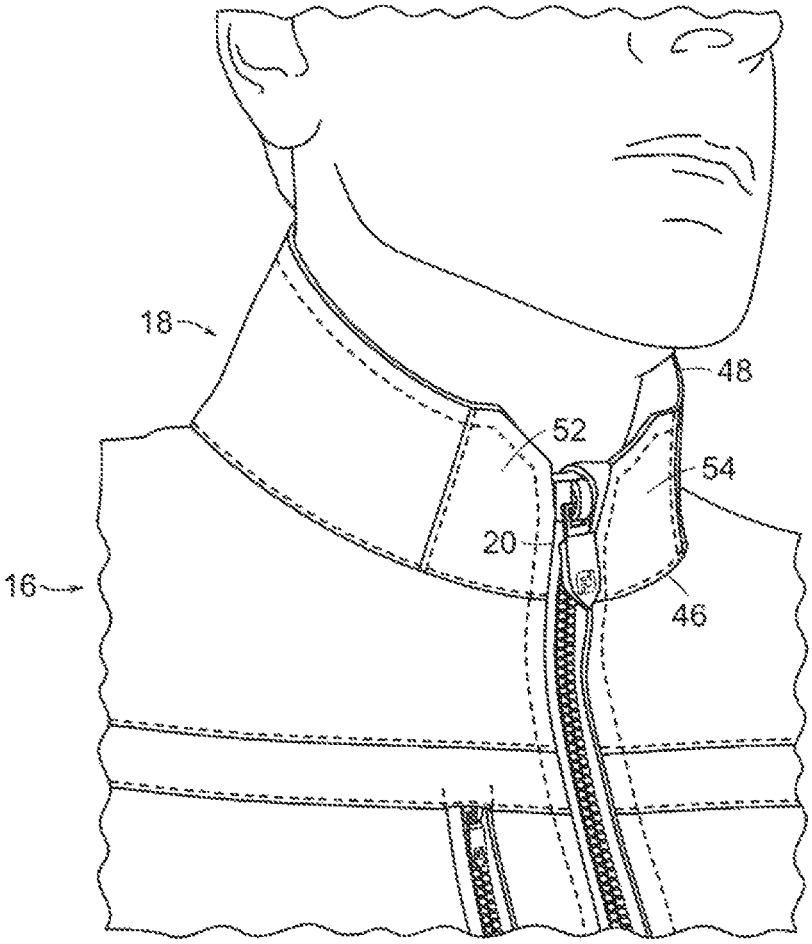
FIG. 1C is a close-up front view of the golf jacket collar shown in FIG. 1.

Although the height of the center section (H1) is greater than the height of each end section (H2), it is important the front area of the collar does not extend upwardly over the chin area of a person wearing the jacket. As shown in FIGS. 1B and 1C, the forward-facing area of the collar (18) has a maximum height such that the upper edge (48) does not extend over the chin/lower jaw area. It is important that a person wearing the golf jacket be able to move his or her head freely and easily. The collar (18) should not restrict any movement, and it should be comfortable around the neck. Since the upper edge (48) of the front area of the collar (18) does not extend over the chin area, the wearer of the jacket has good range of head/neck motion. This flexibility is particularly important when addressing the golf ball and making shots on the course. Furthermore, the collar (18) does not have any large shoulder or abutment areas designed for fitting helmets, masks, or other head gear with the jacket. Instead, the upper edge of the collar (18) provides a fitted and stylish look. With this trim and sporty design, the jacket can be worn in formal and informal settings. The collar (18) is neatly tailored and also provides protection against weather elements so the jacket can be worn comfortably on and off the course.

Figure 5:
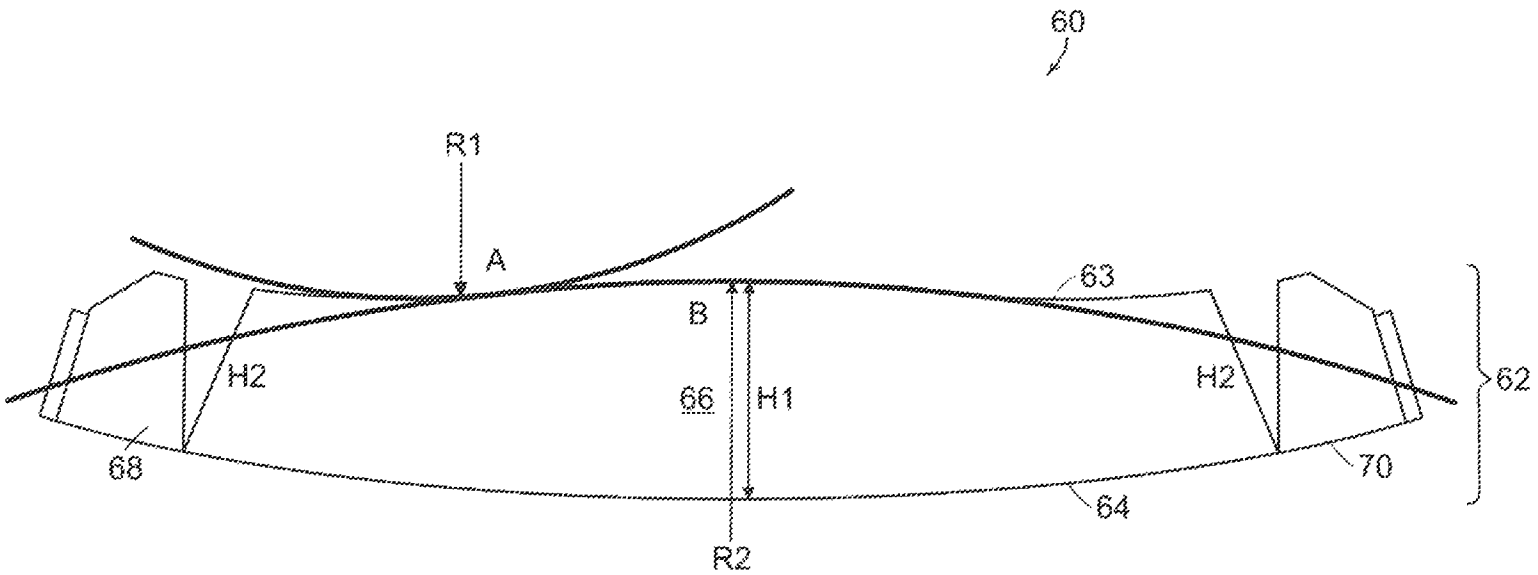
FIG. 5 is a schematic view of a golf jacket collar of the present invention showing an outside view of the collar.

As discussed above, the height of the center section (50) and end sections (52, 54) are different. In one preferred embodiment, the H1 and H2 have the mathematical relationship of: $H1 \geq (1.2)H2$. In another preferred embodiment, the H1 and H2 have the mathematical relationship of: $(1.2)H2 < H1 < (1.4)H2$. Also, in one embodiment, as shown in FIG. 5, the shaped collar (60) includes a body member (62) with lower and upper edges (63, 64), wherein the outside surface of upper edge (63) (at Point A) is tangential to a first circle circumscribed on the outside surface; and the inside surface of upper edge (63) (at Point B) is tangential to a second circle circumscribed on the inside surface. And, the radius of the first circle (R1 with tangential Point A) is less than the radius of the second circle (R2 with tangential Point B). For example, in one embodiment, the first circle has a radius (R1) of 10.5 inches; while the second circle has a radius (R2) of 33.5 inches. The shaped collar (60) is similar to the shaped collar (18) in FIGS. 4 and 4A in that the height of the center section (66) (at point H1) is greater than the height of the of the first and second end sections (68, 70) (at point H2).

In a preferred embodiment of the golf jacket of this invention, a zipper extends from the torso to collar portion as discussed above. The zipper includes first and second sets of complementary zipper teeth for fastening the first and second side members of the torso portion together and the first and second side members of the collar portion together. The first zipper teeth are attached to an edge of the first pieced section and the second zipper teeth are attached to an edge of the second pieced section. When the zipper is pulled-up to close the collar portion, the collar is closed around the neck region of the wearer. When closed, the collar provides a neat, uniformed look. The collar is sufficiently rigid so that it will stay in place and prevent a wearer's neck region from being exposed to rain and other elements and yet the collar is not excessively tight. The collar has a soft and comfortable "feel" and a person wearing the jacket can bend their neck and move easily even when the collar is in a fully closed position. Also, as shown in FIG. 1, the first and second pieced end sections (52, 54) of the collar may have sloped upper edges (59, 61). When the collar is zippered-up and these angled upper edges (59, 61) are joined together, a truncated V-shaped notch is formed in the collar.

The jacket of the present invention has many advantages including comfort, flexibility, and durability. The jacket is relatively lightweight and provides the golfer with a complete range of motion. And yet, the jacket is durable enough to protect the golfer from severe weather conditions. For example, some golfers prefer to walk the golf course. Even golfers, who prefer to drive carts, will walk a considerable distance during their round of play. This can be particularly difficult in stormy weather. Thus, a golf jacket needs to protect the wearer from rain, wind, and other outside elements, but it also must allow a person to move freely so they can walk and play the game easily. Thus, the jacket needs to have some rigidity, but it also needs to be sufficiently flexible. The golf jacket of the present invention is durable and stable and yet it is sufficiently flexible. The jackets of this invention also can be worn while engaging in many other activities such as tennis, boating, exercise classes, running, and walking. Alternatively, the jackets may be worn as casual wear outside of athletic programs.

As discussed above, one particular advantageous feature of the jacket is the collar construction. As shown in FIG. 3, in conventional jackets, there is a tendency for the jacket to "sag" in the collar region (32). This stretching and sagging of the collar (32) may expose the neck region to sun, wind, rain, sleet, and other elements. Furthermore, the excessively loose collar may bother the golfer while he/she is focusing on the ball and making a shot. In play, golfers bend their neck and keep their head down when swinging a club. If the collar sags or is stretched excessively, it can be a distraction to the golfer. If there is loose collar material hanging down, it can interfere with the golfer when he/she is bending over and addressing the ball. In contrast to such conventional collars, the collar construction of the present invention (as shown in FIG. 1) provides a snug and structured fit around the neck region. As discussed above, the height of the center section is greater than the height of the first and second end sections. Thus, the collar fits higher on the back portion of the neck. In this way, the collar provides an effective water-tight seal and prevents rain, sleet, and other elements from running down the back of the neck. The collar maintains its weather-protective seal around the neck of the wearer during walking, golfing, or any other activity. The collar is held firmly in position during these activities. This uniformed look is aesthetically-pleasing and also comfortable. Also, there is no sagging collar material to distract or interfere with the golfer when he/she is looking down at the ball to make a shot. The collar is held tightly in place and yet is comfortable around the neck region.

It is understood that the jacket materials and constructions described and illustrated herein represent only some embodiments of the invention. It is appreciated by those skilled in the art that various changes and additions can be made to materials and structures without departing from the spirit and scope of this invention. It is intended that all such embodiments be covered by the appended claims.

I claim:

1. A jacket comprising a shell, the shell comprising:

i) a torso portion for extending from a shoulder region to hip region of a wearer; and ii) a collar portion for extending around a neck region of a wearer, the torso and collar portions each including first and second side members;

iii) a zipper extending from the torso portion to the collar portion, the zipper including first and second sets of complementary zipper teeth for fastening the first and second side members of the torso portion together and first and second side members of the collar portion together; the collar portion comprising a body member, the body member having:

a center section, the center section having a center section upper edge and a center section lower edge, and first and second pieced end sections, each of the first and second pieced end sections comprising:

a lower edge, a proximal lateral edge, a distal lateral edge, two upper edges and an apex, the two upper edges converging at the apex, the apex being between the proximal lateral edge and the distal lateral edge, the two upper edges forming a truncated v-shaped notch in the collar portion when the first and second pieced end sections are joined together by zippering the collar portion, the first set of complementary zipper teeth being attached to the distal lateral edge of the first pieced end section and the second set of complementary zipper teeth being attached to the distal lateral edge of the second pieced end section and wherein the center section has a first height from the center section lower edge to the center section upper edge, the first and second pieced end sections have a second height from the lower edge to a first of the two upper edges at the proximal lateral edge, the first and second pieced end sections having a third height from the lower edge to the apex, the first and second pieced end sections having a fourth height from the lower edge to the second of the two upper edges at the distal lateral edge, the first height is greater than the second height and the second height is greater than the fourth height.

2. The jacket of claim 1, wherein the first height and the second height have the mathematical relationship of: first height >greater than (1.2)second height.

3. The jacket of claim 1, wherein the first height and the second height have the mathematical relationship of: (1.2) second height <less than first height <less than (1.4) second height.

4. The jacket of claim 1, wherein the first and second pieced end sections are joined to the body member by a seam of stitching.

5. The jacket of claim 1, wherein the lower edge of each of the first and second pieced end sections form an angle of thirty-five degrees with the center section lower edge.

* * * * *